US007481604B2

(12) United States Patent
Perpezat et al.

(10) Patent No.: US 7,481,604 B2
(45) Date of Patent: Jan. 27, 2009

(54) MACHINE FOR DIGGING A TRENCH AND MAKING A WALL IN SAID TRENCH

(75) Inventors: Daniel Perpezat, Nanterre (FR); Gérard Evers, Nanterre (FR); Jean-Pierre Hamelin, Nanterre (FR)

(73) Assignee: Compagnie du Sol, Nanterre (FR)

( * ) Notice: Subject to any disclaimer, the term of this patent is extended or adjusted under 35 U.S.C. 154(b) by 449 days.

(21) Appl. No.: 11/200,660

(22) Filed: Aug. 9, 2005

(65) Prior Publication Data

US 2006/0032094 A1 Feb. 16, 2006

(30) Foreign Application Priority Data

Aug. 10, 2004 (FR) ..... 04 08789

(51) Int. Cl.
*E02F 5/02* (2006.01)

(52) U.S. Cl. ..... 405/267

(58) Field of Classification Search ..... 405/267
See application file for complete search history.

(56) References Cited

U.S. PATENT DOCUMENTS 3,893,302 A 7/1975 Peterson
4,793,736 A * 12/1988 Thompson et al. ..... 405/146

FOREIGN PATENT DOCUMENTS

| | | | |
|---|---|---|---|
| DE | 730768 C | | 1/1943 |
| JP | 09078626 A | * | 3/1997 |
| JP | 2001279664 A | * | 10/2001 |
| NL | 7004298 A | | 9/1971 |
| NL | 1007263 C2 | | 4/1999 |

* cited by examiner

*Primary Examiner*—John Kreck
(74) *Attorney, Agent, or Firm*—Kenyon & Kenyon LLP

(57) ABSTRACT

The present invention relates to a machine for digging a trench and making a wall in said trench, the machine being suitable for advancing along a path and having rear and front portions relative to the direction of advance of the machine, together with excavator means disposed in the front portion of the machine and defining a substantially vertical cutting front; wall-forming means situated in the rear portion of the machine; and propulsion means suitable for causing the machine to advance along said path. The machine also has a central portion, controllable brake means for slowing advance or blocking at least one portion of the machine, and controllable connection and disconnection means for connecting and disconnecting the central portion respectively with the front and rear portions of the machine, thereby enabling the type of excavator means and the type of wall-forming means to be changed.

36 Claims, 8 Drawing Sheets

MACHINE FOR DIGGING A TRENCH AND MAKING A WALL IN SAID TRENCH

FIELD OF THE INVENTION

The present invention relates to excavator machines for forming long walls in the ground, which walls may be continuous or discontinuous.

More precisely, the invention relates to a machine for digging a trench and making a wall in said trench, the machine being suitable for advancing along a path and comprising rear and front portions relative to the direction of advance of the machine, together with:

- excavator means disposed in the front portion of the machine and defining a substantially vertical cutting front;
- wall-forming means situated in the rear portion of the machine; and
- propulsion means suitable for causing the machine to advance along said path.

BACKGROUND OF THE INVENTION

Machines of this type and suitable for forming walls are already known.

For example, U.S. Pat. No. 3,893,302 describes a machine and method for excavating trenches and constructing walls in the excavated trenches.

That machine comprises a cutter tool located in the front portion of the machine, in the form of an endless chain of excavation buckets.

The rear portion of the machine has a vertical duct for delivering concrete from a container situated outside the trench to the rear of the machine in order to fill the trench that has just been dug.

Pumping concrete into the trench creates hydrostatic pressure on the rear portion of the machine, thereby exerting driving thrust in the excavation direction.

However, that machine is subjected to the hydrostatic pressure of the concrete and, in any event, no means are provided for controlling either the thrust force created by the pressure of the concrete on the excavator means, or the speed of advance of the machine.

It is known that the thrust force and the speed of advance of the cutter tool need to be controlled, regardless of the nature of the terrain being excavated.

In particular, the force created by the hydraulic pressure is usually greater than the force needed for applying pressure to the cutter tools.

It will therefore be understood that it is necessary to control the speed of advance of the machine and also the thrust force on the cutter tools.

In addition, in that document, it is not possible to adapt the cutter tools to the nature of the terrain to be excavated.

In the event of it being desirable to change the cutter tool, it is necessary to change the machine, which leads to a loss of time that might paralyze progress on a building site.

Finally, the machine described in that document is capable solely of forming diaphragm type walls, whereas in certain situations it can be advantageous to place prefabricated wall elements in the trench, and to do so without needing to change the excavator machine or the cutter tool.

OBJECTS AND SUMMARY OF THE INVENTION

An object of the present invention is to remedy the above-mentioned drawbacks to a considerable extent.

This object is achieved by the fact that the machine further comprises a central portion, controllable brake means for slowing advance or blocking at least one portion of the machine, and controllable connection and disconnection means for connecting and disconnecting the central portion respectively with the front and rear portions of the machine, thereby enabling the type of excavator means and the type of wall-forming means to be changed.

It will be understood that the controllable brake means enable the advance of the machine and the force applied to the excavator means to be controlled by braking at least a portion of the machine whenever its speed is greater than a predetermined value or whenever the force applied to the excavator means is too great.

Such control thus serves to optimize excavation.

In addition, the controllable connection and disconnection means make it easy to dismount the excavator means from the central portion of the machine. Similarly, they make it easy to dismount the means for forming a wall from the central portion of the machine.

It will thus be understood that the excavator means can be dismounted while the machine is in the trench, such that the excavator means can easily be adapted to the nature of the terrain to be excavated.

Such dismounting can also make maintenance and upkeep operations easier.

In addition, the means for forming a wall may also be adapted to the nature of the terrain or indeed to the type of wall that is it is desired to form. This makes it possible in particular to modify the structure of the wall locally without needing to change the excavator machine.

It will thus be understood that the modularity of the present machine enables it to be adapted to any type of terrain and to any type of requirement concerning how the walls are to be made.

In a first embodiment of the machine of the invention, the wall-forming means comprise at least one concreting liquid injector for filling the portion of trench situated behind the machine, the machine further comprises guide means situated in the central portion and suitable for modifying the path by causing the cutting front to pivot in a horizontal plane relative to the rear portion of the machine, and the propulsion means comprise said at least one concreting liquid injector.

The term "concreting liquid" should be understood to cover any building material capable of being in a liquid state prior to setting, for example cement or concrete.

In this embodiment, the thrust exerted by the hydrostatic pressure of the concreting liquid is used and controlled for the purpose of causing the machine to advance.

It will be understood that the angle of orientation of the cutting front has a direct influence on advance of the machine and that turning the cutting front leads to curvature in the path of the machine, such that unlike the above-specified prior art document, it is advantageously possible to make curved walls.

Advantageously, the front portion of the machine can pivot relative to the rear portion of the machine, and the guide means comprise at least one actuator engaged between the front and rear portions of the machine, so that actuating said at least one actuator causes the front portion to pivot relative to the rear portion of the machine.

Preferably, the excavator means are suitable for pivoting relative to the wall-forming means about a pivot axis that is substantially vertical so as to cause the cutting front to pivot in a plane that is substantially horizontal.

Advantageously, the guide means comprise at least two rows of actuators, said rows being disposed vertically on either side of a horizontal midplane of the machine.

Advantageously, the wall-forming means comprise at least one row of injectors disposed vertically, pointing rearwards relative to the direction of advance of the machine, so as to inject the concreting liquid under pressure into the trench behind the machine, so that the injection of liquid under pressure also contributes to propelling the machine.

It will be understood that injecting concreting liquid under pressure makes it possible to fill the trench and create a propulsion force acting in the direction opposite to the direction in which the liquid is injected.

In addition, when the portion of the trench located behind the machine is filled with liquid, the hydraulic pressure of said concreting liquid applies a propulsion force on the machine directed in the direction of advance of the machine.

Thus, injecting the liquid serves to propel the machine of the invention.

Advantageously, the excavator means are movable relative to the wall-forming means, and the machine further comprises thrust means situated in the central portion of the machine, suitable for exerting a horizontally- and/or vertically-oriented force on the excavator means.

Preferably, these thrust means are suitable for producing and controlling both a thrust force and a speed of displacement, regardless of the nature of the ground to be excavated.

In particular, the vertical thrust force of the excavation means along the cutting front serves to "saw" the trench.

A horizontal thrust force of the cutter tools can advantageously be associated with the vertical force in order to combine a horizontal force and a vertical force on the cutting front.

This "jigsaw" method of excavation can be highly effective, particularly when it is desired to adapt the cutter tool to the depth of the trench to be made.

In a second embodiment of the machine of the invention, the excavator means are movable relative to the wall-forming means, and the propulsion means are situated at least in part in the central portion of the machine and are suitable for moving the excavator means horizontally and/or vertically relative to the wall-forming means.

Advantageously, the brake means comprise a rear brake device suitable for blocking the rear portion of the machine relative to the trench, and the propulsion means are suitable for moving the excavator means forwards when the rear portion of the machine is blocked by said rear brake device.

It will be understood that when the rear brake device is actuated, the excavator means are movable relative to the trench.

In this way, it is possible to exert thrust on the excavator means by advantageously pressing against the trench via the rear brake device.

Advantageously, the wall-forming means comprise a device for inserting prefabricated wall elements behind the machine, and the propulsion means are suitable for bearing against an inserted prefabricated wall element in order to enable the excavator means to be moved horizontally and/or vertically.

The prefabricated wall elements are walls that have been molded prior to being introduced into the trench.

For example, certain types of site require walls to be used that include prestressed cables.

Since such walls cannot be made by being molded in situ, they are fabricated before being inserted in a trench.

It will be understood that it can be advantageous to be able to insert such walls locally without it being necessary to change the machine, and that this is made possible by the present invention.

Preferably, the propulsion means bear against the most-recently inserted prefabricated wall element in the trench that is located immediately behind the machine.

Advantageously, in another embodiment, the wall-forming means comprise at least one concreting liquid injector designed to fill the portion of trench situated behind the machine, and the propulsion means further comprise said at least one concreting liquid injector.

Advantageously, the brake means further comprise a front brake device suitable for blocking the front portion of the machine relative to the trench, and the propulsion means are suitable for moving the rear portion of the machine towards the front portion when the front portion is locked by said front brake device.

It will be understood that when the front portion of the machine is blocked relative to the trench, the rear portion is movable relative to the trench.

Thus, when the front portion of the machine is blocked, the rear portion can be moved towards the front portion, thereby enabling the rear portion of the machine to be advanced in the excavation direction.

Thereafter, it is possible to block the rear brake device or to bear against a prefabricated wall element or indeed to bear directly against a volume of injected liquid in order to move the excavator means forwards, so as to cause the machine as a whole to advance.

As will be understood, performing these two movements in succession enables the machine to advance, and this can preferably, although not necessarily, be accompanied by injecting concreting liquid behind the machine.

Advantageously, the machine further comprises thrust means suitable for exerting horizontal and/or vertical thrust on the excavator means.

Preferably, the thrust means are suitable for producing and controlling a thrust force and/or a displacement speed, as a function of the nature of the ground to be excavated.

In particular, thrusting the excavator means vertically along the cutting front makes it possible to "saw" the trench.

In this situation, thrusting the cutter tools horizontally can advantageously be associated with thrusting them vertically so as to combine both a horizontal force and a vertical force on the cutting front.

Depending on the nature of the ground, it can be advantageous to block the rear portion of the machine relative to the trench so as to guarantee a stable bearing point for taking up the reaction due to the movements of the excavator means.

Advantageously, the thrust means comprise at least one actuator secured between the front portion and the rear portion, disposed in a substantially horizontal direction, and suitable for exerting horizontal thrust on the excavator means.

Preferably, the actuators are distributed in at least two rows of horizontal actuators, said rows being disposed vertically.

Advantageously, the thrust means comprise at least one actuator engaged between the central portion and the front portion of the machine, disposed in a substantially vertical direction, and suitable for exerting vertical thrust on the excavator means.

Preferably, the thrust means comprise at least two rows of vertical actuators, said rows being disposed vertically.

Preferably, the controllable brake means comprise a front brake device comprising at least one actuator extending transversely relative to the path of the machine and co-operating with the front portion of the machine, said at least one actuator being provided at its free end with a friction plate suitable for being put into contact with a face of the trench when said actuator is actuated.

Preferably, the controllable brake means comprise a rear brake device comprising at least one actuator extending transversely relative to the path of the machine and co-operating with the rear portion of the machine, said at least one actuator being provided at its free end with a friction plate suitable for being put into contact with a face of the trench when said actuator is actuated.

The invention also concerns a machine for digging a trench and making a wall in said trench, the machine being suitable for advancing along a path and comprising rear and front portions relative to the direction of advance of the machine, together with:

excavator means disposed in the front portion of the machine and defining a substantially vertical cutting front;

wall-forming means situated in the rear portion of the machine; and propulsion means suitable for causing the machine to advance along said path;

the machine further comprising a central portion, controllable brake means for slowing advance or blocking at least one portion of the machine, and controllable connection and disconnection means for connecting and disconnecting the central portion respectively with the front and rear portions of the machine, thereby enabling the type of excavator means and the type of wall-forming means to be changed, wherein the wall-forming means comprise at least one concreting liquid injector for filling the portion of trench situated behind the machine, wherein the machine further comprises guide means situated in the central portion and suitable for modifying the path by causing the cutting front to pivot in a horizontal plane relative to the rear portion of the machine, wherein the propulsion means comprise said at least one concreting liquid injector, and wherein the wall-forming means comprise at least one row of injectors disposed vertically, pointing rearwards relative to the direction of advance of the machine, so as to inject the concreting liquid under pressure into the trench behind the machine, so that the injection of liquid under pressure also contributes to propelling the machine.

The invention also concerns a machine for digging a trench and making a wall in said trench, the machine being suitable for advancing along a path and comprising rear and front portions relative to the direction of advance of the machine, together with:

excavator means disposed in the front portion of the machine and defining a substantially vertical cutting front;

wall-forming means situated in the rear portion of the machine; and propulsion means suitable for causing the machine to advance along said path;

the machine further comprising a central portion, controllable brake means for slowing advance or blocking at least one portion of the machine, and controllable connection and disconnection means for connecting and disconnecting the central portion respectively with the front and rear portions of the machine, thereby enabling the type of excavator means and the type of wall-forming means to be changed, wherein the excavator means are movable relative to the wall-forming means, and wherein the propulsion means are situated at least in part in the central portion of the machine and are suitable for moving the excavator means horizontally and/or vertically relative to the wall-forming means.

BRIEF DESCRIPTION OF THE DRAWINGS

The invention will be well understood and its advantages will appear clearly on reading the following detailed description of embodiments given as non-limiting examples. The description refers to the accompanying drawings, in which.

MORE DETAILED DESCRIPTION

The machine 10 of the invention is for making walls in the ground, such as concrete walls.

It serves in particular to make continuous diaphragm walls that are rectilinear or curvilinear, i.e. presenting a radius of curvature, and also discontinuous walls formed by juxtaposing prefabricated wall elements.

The machine 10 serves initially to excavate a trench in the ground, and then to form a wall in the excavated trench.

Figure 1:
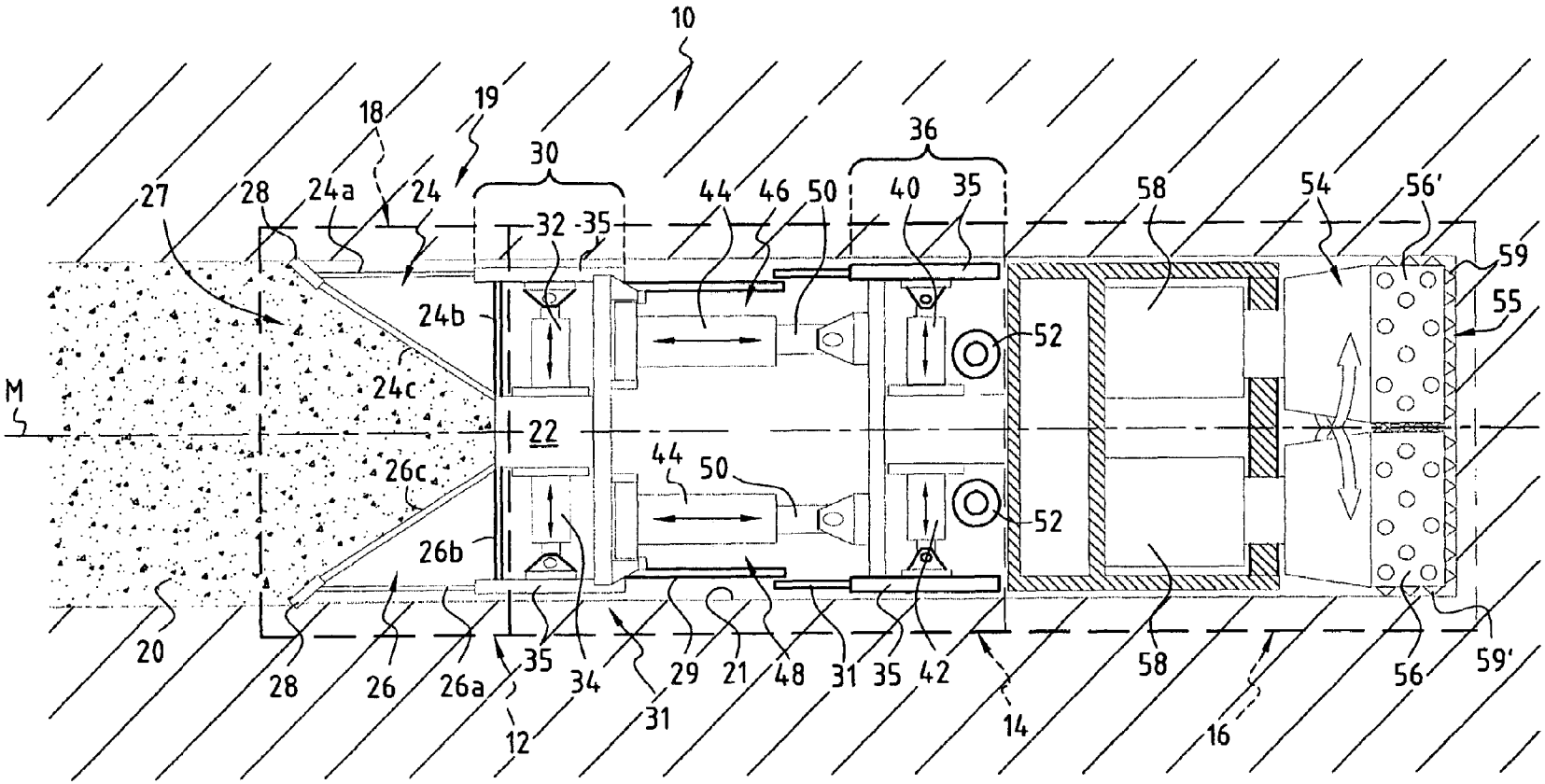
FIG. 1 is a plan view of the machine of the invention while excavating and forming a continuous wall.

With reference to FIG. 1, there follows a description of the general structure of the machine 10 of the invention.

As can be seen in FIG. 1, considered in its direction of advance, the machine 10 has a rear portion 12, a central portion 14, and a front portion 16.

The dimensions of the machine 10 are such that its width is substantially equal to or slightly less than the width of the wall that is to be formed, its height in a vertical direction is substantially equal to or slightly less than the depth of the wall to be formed, and its length is a few meters.

The rear portion 12 of the machine of the invention comprises means 18 for forming a wall 20 in a trench 21.

In particular, these wall-forming means may comprise a concreting module 19, as shown in FIG. 1.

The concreting module 19 preferably comprises a plurality of injectors 22 for injecting concreting liquid (e.g. liquid concrete), which injectors are disposed vertically up the entire height of the machine 10.

The injectors 22 are disposed in such a manner that their outlets point substantially in the longitudinal direction of the trench, rearwards relative to the excavation direction.

The injectors 22 are preferably disposed in a vertical row.

These injectors 22 are fed by a feed pipe, itself connected to a concreting liquid container situated on the surface (not shown).

Each injector 22 is preferably fed separately so that the flow rate and/or the pressure of the liquid leaving any one injector 22 can be controlled independently of the others.

As can be seen in FIG. 1, the wall-forming means 18, preferably but not necessarily, comprise two vertical elements 24 and 26 of triangular section disposed on either side of the row of injectors so as to form shuttering 27.

Preferably, each vertical element 24, 26 has one face 24*a*, 26*a* parallel to the face of the trench, when seen vertically in plan view, one face 24*b*, 26*b* that is orthogonal to said trench face, and one face 24*c*, 26*c* that is inclined relative to said trench face.

At its rear end relative to the direction of advance of the machine, each vertical element 24, 26 has a shoe 28 extending the end of said vertical element in such a manner as to prevent the concrete from penetrating between a vertical element and said face of the trench 21.

The concreting module 19, and more generally the wall-forming means 18, are connected to the central portion 14 by controllable means for connecting and disconnecting the rear portion 12 relative to the central portion 14 of the machine 10.

These controllable connection and disconnection means serve advantageously to enable the type of wall-forming means 18 to be changed while leaving the other elements of the machine 10 in the trench 21.

Figure 2:
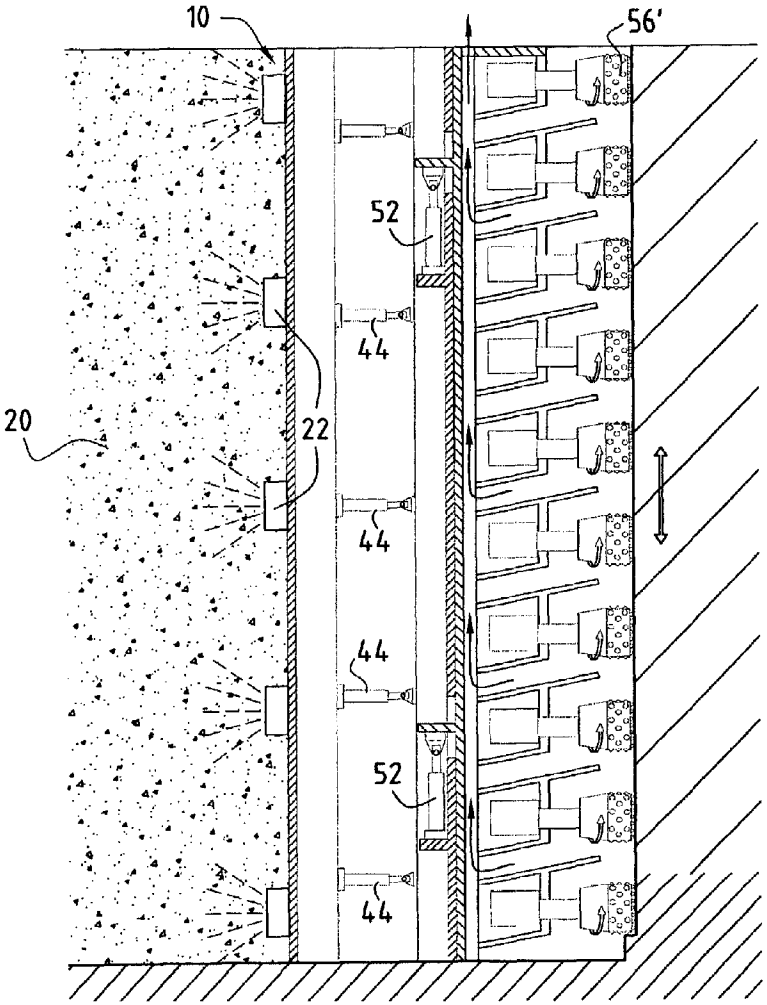
FIG. 2 is a side view of the machine of the invention showing a first variant of the cutter module.
Figure 6:
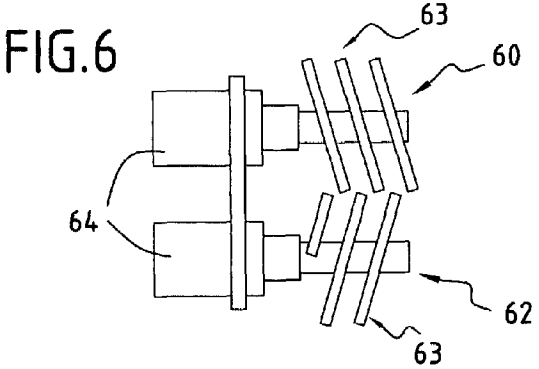
FIG. 6 is a detail view of the second variant of the cutter module seen from above.

With reference to FIGS. 1 and 2, there follows a description of the central portion 14 of the machine 10.

Relative to the direction of advance of the machine 10, said central portion 14 has a rear end 29 secured to the rear portion by the means for connecting and disconnecting the central portion 14 and the rear portion, and a front end 31 secured to the front portion 16 by means for connecting and disconnecting the central portion and the front portion 16.

Said central portion 14 further comprises controllable brake means that are adapted to block or brake advance of the machine 10 relative to the trench.

Relative to the direction of advance of the machine, the controllable brake means comprise a rear brake device 30 situated on the rear end 29 of the central portion, preferably comprising two vertical walls of hydraulic actuators 32 and 34, each row being secured to a respective one of the two sides of the rear end 29 of the central portion 14.

Preferably, each actuator 32 and 34 extends transversely relative to the path followed by the machine 10.

In addition, each hydraulic actuator 32, 34 is provided at one of its ends with a friction plate 35 suitable for being put into contact with the face of the trench when the corresponding actuator is actuated.

The friction plates 35 are made of a material presenting a high coefficient of friction, such that when the plate is put into contact with a face of the trench, that contributes to creating a friction force between the central portion 14 and the trench 21 so as to block or brake advance of at least a portion of the machine 10, specifically the rear portion 12 which is secured to the rear end 29 of the central portion 14 of the machine 10.

The rear brake device 30 is designed in such a manner that each hydraulic actuator 32, 34 is controllable independently of the others. Preferably, the actuators are controllable in pairs of actuators situated at the same height, each pair thus being controllable independently of the other pairs of actuators.

In similar manner, the controllable brake means further comprise a front brake device 36 mounted on the front end 31 of the central portion 14.

The front brake device 36 preferably comprises two vertical rows of hydraulic actuators 40, 42, each row being secured to a respective one of the two sides of the front end 31 of the central portion 14.

Preferably, each actuator 40, 42 extends transversely relative to the path of the machine 10.

In addition, each hydraulic actuator 40, 42 is likewise provided at one of its ends with a friction plate 35 suitable for being put into contact with a side of the trench when the corresponding actuator is actuated.

The friction plates 35 are made of a material presenting a high coefficient of friction, such that when a friction plate 35 is put into contact with a side of the trench 21, that contributes to creating a friction force between the central portion 14 and the trench 21 so as to block or brake advance of at least a portion of the machine 10, specifically the front portion 16 which is secured to the front end 31 of the central portion 14 of the machine 10.

The front brake device is designed in such a manner that each hydraulic actuator 40, 42 is controllable independently of the others. Preferably, the actuators are controllable in pairs. Specifically, each pair of actuators situated at the same height, seen in a vertical direction, is controllable independently of the other pairs of actuators.

Naturally, the front and rear brake devices 30 and 36 can be actuated simultaneously or else separately depending on the desired type of braking or blocking.

Preferably, the front and rear ends 29 and 31 of the central portion 14 are movable relative to each other in translation in the longitudinal direction of the machine 10. They are also movable relative to each other in vertical pivoting about a horizontal axis and in horizontal pivoting about a vertical axis.

In order to enable the two ends 29 and 31 to move in longitudinal translation relative to the other, at least one actuator 44 is disposed longitudinally between the front and rear ends 29 and 31 of the central portion 14.

More precisely, the two ends of the actuator 44 are secured to the front and rear ends 29 and 31 of the central portion 14 in such a manner that actuating the actuator 44 causes the front end 31 of the central portion 14 to move relative to the rear end 29, and consequently causes the front portion 16 of the machine 10 to move relative to the rear portion 12 in a direction that is substantially parallel to the path of the machine 10.

Preferably, two vertical rows 46 and 48 of actuators 44 are disposed longitudinally between said ends 29 and 31 over the entire height of the machine so that the thrust force of the actuators 44 is distributed substantially uniformly over the entire height of the machine 10.

The term "thrust" is used here to cover both the thrust force proper and the displacement speed applied to the excavator means.

Nevertheless, the actuators 44 can be controlled separately in such a manner that the thrust of the actuators 44 on the front end 31 of the central portion 14 may be a function of the vertical position of each actuator 44.

The rows are preferably disposed on either side of a vertical midplane M of the machine 10.

It will be understood that in this manner it is also possible to cause the front end 29 to pivot in a substantially horizontal plane relative to the rear end 31 when the stroke of the pistons 50 of the actuators 44 in one of the two rows 46 is greater than that of the pistons of the actuators in the other row 48.

In order to enable movement in vertical translation between the two ends, at least one hydraulic actuator 52 is disposed vertically between the central portion 14 and the front portion 16 of the machine 10, as shown in FIG. 2.

More precisely, a first end of the hydraulic actuator 52 is secured to the front end 31 of the central portion 14, while a second end of the actuator 52 is secured to the front portion 16 of the machine, so that actuating the actuator 52 causes the front portion 16 to move relative to the front end 29 of the central portion 14, and consequently causes the front portion 16 to move in a substantially vertical direction relative to the rear portion 12 of the machine 10.

At least one vertical row of actuators 52 is preferably disposed along the height of the machine 10 in such a manner as to accumulate the power of the vertically-disposed actuators 52.

Still with reference to the figures, there follows a description of the front portion 16 of the machine 10 of the invention.

The front portion 16 of the machine 10 of the invention has excavator means for digging the trench 12 in the direction of advance of the machine 10.

The excavator means, also referred to as the "cutter module", comprise cutter tools 54 that are suitable for excavating the trench over its entire depth. The term "cutting front 55" is used to designate the cutting surface defined by the cutter tools 54 of the excavator means.

Figure 3:
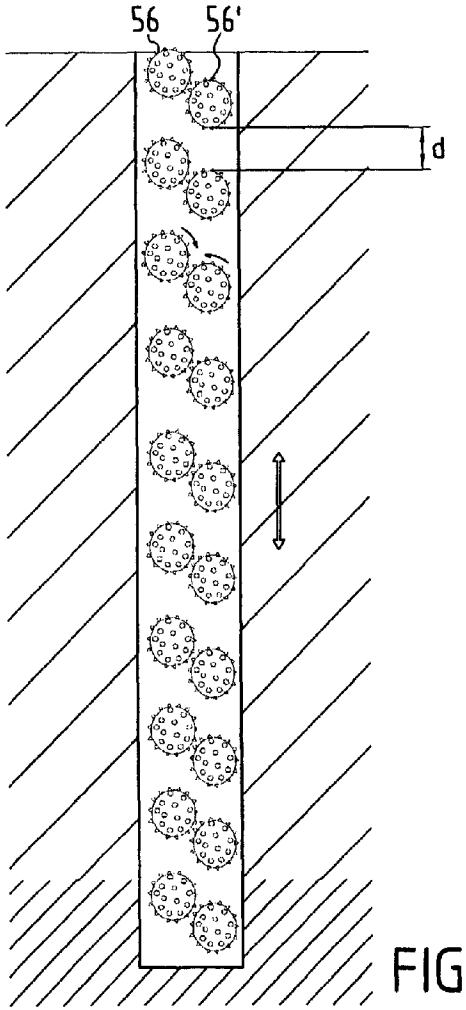
FIG. 3 is a front view of the machine of the invention showing a first variant of the cutter module.

In a first variant of the cutter module, shown in FIGS. 1 to 3, the cutter tools 54 are distributed up the full height of the machine, each cutter tool 54 being suitable for excavating a portion of the cutting front 55.

In this first variant, the cutter tools 54 comprise rotary cylinders 56 mounted on hydraulic motors 58 and extending substantially along the path of the machine, i.e. orthogonally relative to the cutting front.

The cylinders preferably comprise a plurality of cutter elements 59 disposed on their ends facing the cutting front 55 and cutter elements 59' disposed on their cylindrical side faces.

As can be seen in FIG. 3, in the first variant, the cylinders 56 are disposed in pairs, preferably distributed up the entire height of the machine.

In addition, the two rotary cylinders 56 and 56' of a pair are driven with contrarotating motion, thereby tending to compensate the forces generated.

When the trench to be made is narrow in width, the cutter tool may comprise only cylinders having their axes disposed along a common vertical segment.

The rotary cylinders 56 and 56' are preferably such that the minimum distance between the peripheries of two cylinders is of the order of a few centimeters.

Still with reference to FIG. 3, it can be seen that for a given pair of cylinders, the axis of rotation of one of the two cylinders is situated below the axis of rotation of the other cylinder, so that a given pair of cylinders defines an upper cylinder 56 and a lower cylinder 56'.

The distance between the lower cylinder in a given pair and the lower cylinder of the pair situated immediately beneath the first pair is written d.

In this first variant, the rear brake device 30 is actuated in such a manner that the rear portion 12 of the machine 10 is locked relative to the trench 21.

Advantageously, the machine has thrust means enabling a horizontal and/or vertical thrust force to be exerted on the excavator means.

The thrust means also serve to provide the excavator means with the speed of advance needed to optimize excavation.

The thrust means preferably comprise the horizontally-disposed actuators 44 together with the vertically-disposed actuators 52.

By actuating the horizontally-disposed actuators 44, horizontal thrust is exerted on the cutter module, thereby enabling the cutter elements 59 situated on the ends of the cylinders 56 and 56' to come into contact with the cutting front, and consequently enabling the trench 21 to be excavated, this excavation being accompanied by the action of the cutter elements 59' acting under the effect of the up and down movement of the rotating cutter tool.

In addition, by actuating the vertically-disposed actuators 52, the cutter tools are caused to move with reciprocating up-and-down vertical motion, preferably through an amplitude of not less than d, so as to saw the trench 21 vertically over the entire surface of the cutting front.

The cutter elements 59 situated at the peripheries of the cylinders 56 and 56' contribute to the sawing effect.

It will be understood that by associating vertical thrust and horizontal thrust it is possible to operate in a "jigsaw" type mode.

Furthermore, it can be advantageous to have different types of cutter tool at different heights in order to adapt the module to the nature of the ground to be excavated.

Figure 5:
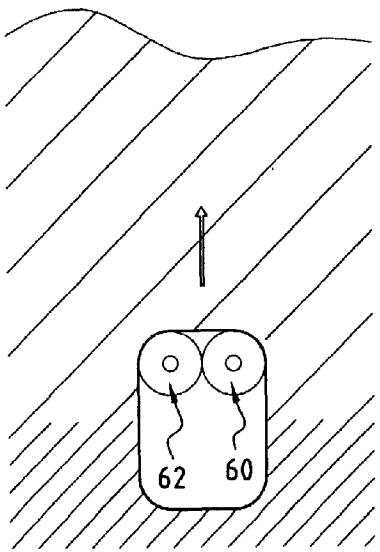
FIG. 5 is a front view of the second variant of the cutter module in the machine of the invention.
Figure 4:
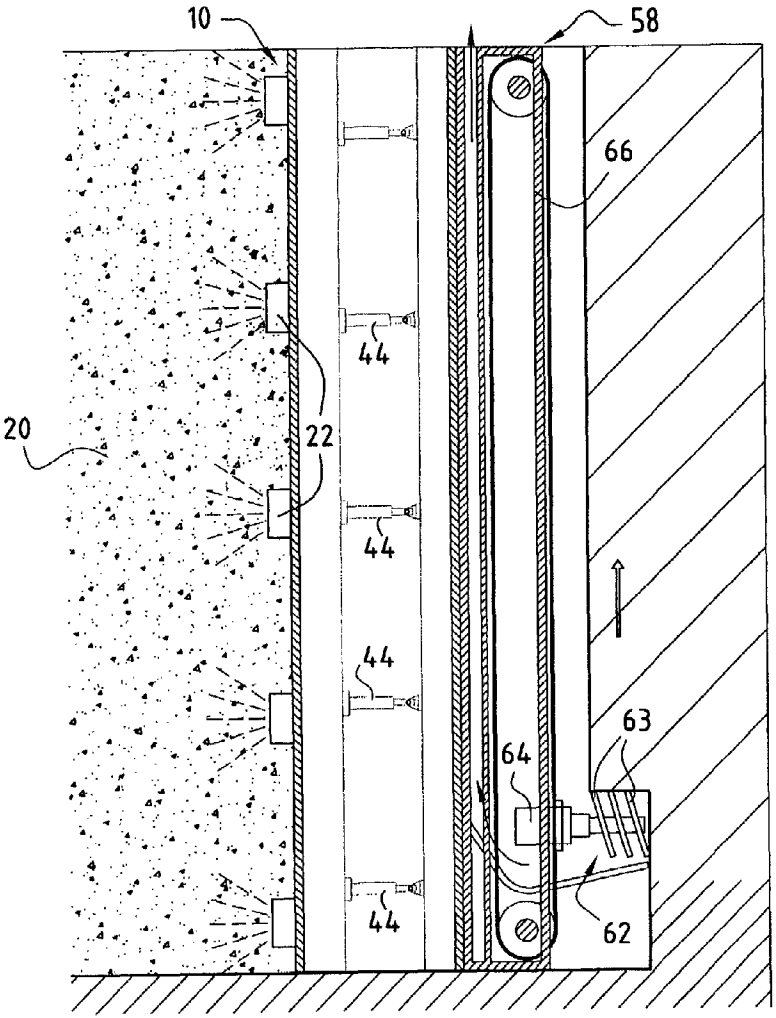
FIG. 4 is a side view of the machine of the invention showing a second variant of the cutter module.

In a second variant 58 of the cutter module, shown in FIGS. 4 and 5, the module comprises cutter tools 60 and 62 suitable for excavating the trench 21 by moving vertically, e.g. from the bottom towards the top of the trench 21.

By way of example, these cutter tools 60 and 62 are in the form of two horizontal earth borers 63, each mounted to rotate on a hydraulic motor 64 whose axis of rotation extends along the path of the machine 10.

The cutter module 58 may also comprise an endless chain 66 extending vertically over the full height of the machine and having cutter tools 60 and 62 mounted thereon. It is possible to use other means for moving the cutter tools over the height of the trench.

It will be understood that the endless chain 66 enables the cutter tools 60 and 62 to be moved vertically, and that the trench 21 is then preferably excavated while the cutter tools 60 and 62 are rising, as shown in FIGS. 4 and 5.

Figure 8:
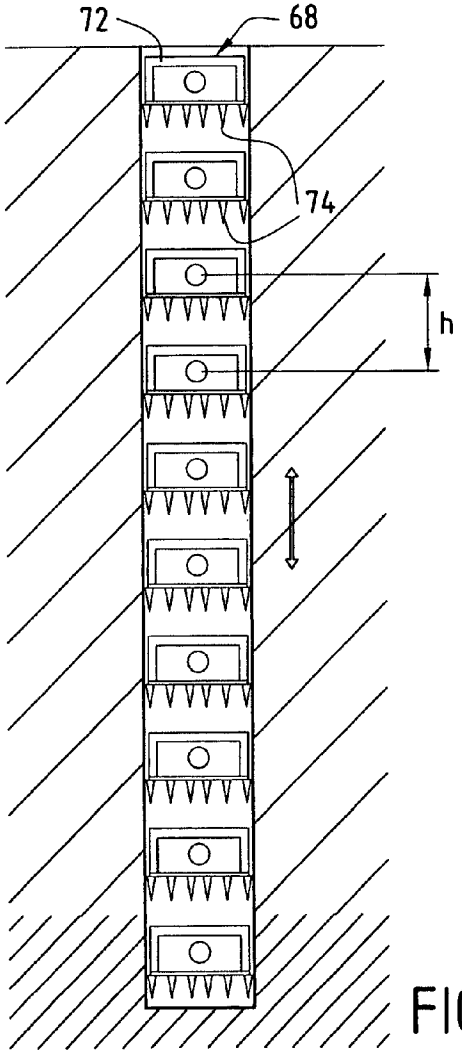
FIG. 8 is a front view of the third variant of the cutter module in the machine of the invention.
Figure 7:
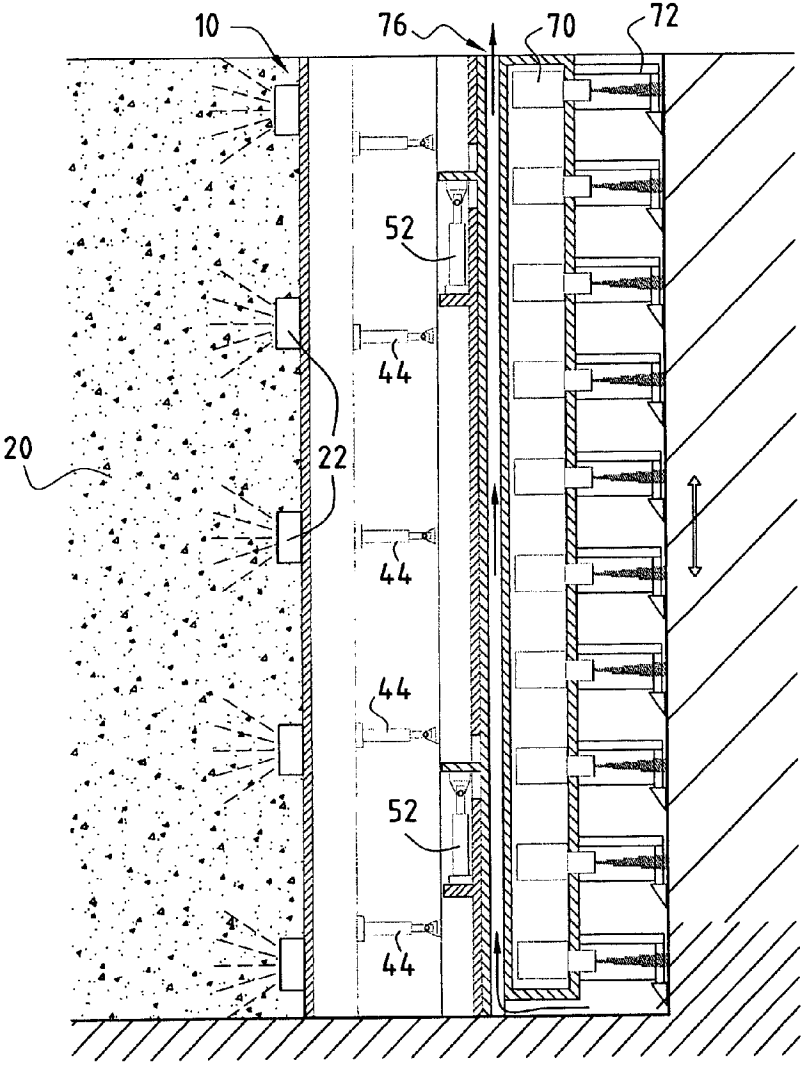
FIG. 7 is a side view of the machine of the invention showing a third variant of the cutter module.

In a third variant of the cutter module, shown in FIGS. 7 and 8, the cutter module comprises a plurality of cutter tools 68 distributed vertically in a row that extends up the height of the machine 10.

The pitch of two adjacent cutter tools 68 is written h.

Each cutter tool 68 comprises a source 70 for a jet of liquid at high pressure suitable for breaking up the ground to be excavated.

To ensure that the source of the jet does not come into contact with the ground for excavating, a grid-forming bearing device 72 is disposed in front of the jet and serves to place the jet at an optimum distance from the ground.

In order to excavate the trench, the jet sources 70 are actuated and the vertically-disposed actuators are also actuated so as to move the cutter module upwards and downwards in alternation through an amplitude of not less than h.

It will be understood that in this way the jets are suitable for acting on substantially the entire depth of the trench 21.

Advantageously, the grid 72 has a series of teeth 74 disposed along the bottom edge of said grid 72 so as to make it easier to move the grid 72 while advancing the cutter module, and also for the purpose of "ploughing" the portion of the ground that has been subjected to the action of the jet in order to facilitate excavation.

In general, and regardless of which variant is considered, the excavator means preferably include evacuation means (not shown) for evacuating the excavated particles, said means being situated in a zone behind the cutter module.

These evacuation means may comprise nozzles for injecting liquid under pressure in the proximity of the tools, and a pipe 76 for sucking the liquid containing the excavated particles up to the surface, outside the trench 21.

With the help of the figures and the above description, there follows a description in greater detail of two embodiments of the machine 10 of the invention, and more particularly of its modes of advance.

Figure 9:
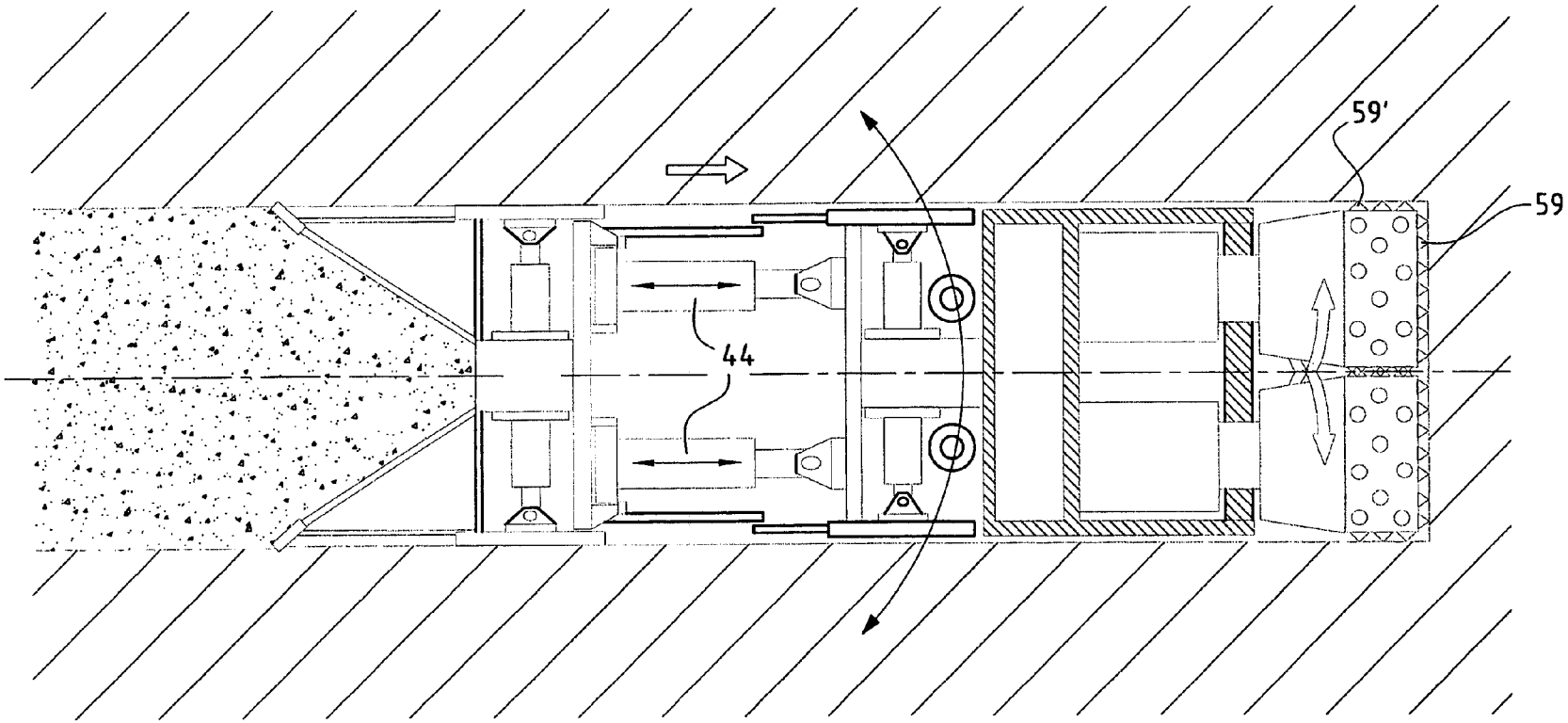
FIG. 9 is a plan view of the first embodiment of the machine of the invention while excavating and forming a continuous wall.

In the first embodiment shown in FIG. 9, the machine 10 of the invention has cutter means comprising a cutter module, and preferably the first variant described in detail above.

The machine 10 also has means for forming a wall 18 in the form of a concreting module 19 as described above, together with propulsion means suitable for causing the machine to move along a path.

The propulsion means comprise the injectors 22 of the concreting means 19 together with the shuttering 27.

In this first embodiment, referred to as "continuous movement mode", the machine of the invention forms a diaphragm wall progressively as the machine advances.

Injecting cement from the machine from the rear ends thereof in the longitudinal direction of the machine generates by reaction a propulsion force directed towards the front of the machine.

This propulsion force is accompanied by the hydraulic pressure from the liquid concrete filling the portion of the trench that is situated behind the machine.

This hydrostatic pressure creates a force pressing against the inclined elements 24*c* and 26*c* of the diverging nozzle, producing a resultant that is likewise directed towards the front of the machine.

It will be understood that this force enables the machine to be propelled and also provides horizontal thrust on the excavator means.

In known manner, the distribution of the hydrostatic pressure per unit area on the inclined shuttering elements is such that pressure increases with depth, which implies that the propulsion force is greater at the bottom of the trench 21 than at the top.

Consequently, it is necessary to control this pressure gradient so as to actively control propulsion of the machine 10.

As shown in FIG. 9, by using the front and rear brake devices 30 and 36, it is advantageously possible to brake the machine 10 of the invention.

Furthermore, since the actuators 32, 34, 40, and 42 of the brake devices 30 and 36 are separately controllable, it is possible to match the braking force locally to the propulsion force acting on the machine 10 at any given height.

In addition, the force exerted by the concrete on the machine 10 is generally greater than the horizontal force that is needed by the excavator means.

The front and rear brake devices 30 and 36 advantageously enable the advance of the machine to be controlled actively by braking only that part of the propulsion force that is greater than the force required by the excavator means, or else when the speed of advance of the excavator means is too great.

In the first embodiment of the invention, the machine thus makes it possible to control actively the force that is exerted by the concrete on the machine, which is not mentioned in the above-described prior art.

The machine 10 constituting the first embodiment of the invention also has guide means essentially comprising the horizontally-disposed actuators 44. As mentioned above, said actuators 44 are arranged in two vertical rows 46 and 48 disposed on either side of a midplane M of the machine 10.

Seen from above, in its central portion 14, the machine 10 has a right-hand row 46 and a left-hand row 48 of horizontally-disposed actuators 44.

From FIG. 9, it can be understood that when only the right-hand row 46 of actuators 44 is actuated so as to extend the actuator rods, the cutter module pivots in a substantially horizontal plane to the left, thereby curving the path along which the machine 10 advances.

Similarly, when only the left-hand row 48 of actuators 44 is actuated, the path along which the machine advances is curved to the right.

It is therefore possible to make continuous diaphragm walls that present non-zero curvature.

In addition, because of the above-described connection and disconnection means, it is easy to change the cutter module 18 for another module while making the diaphragm wall 20, and this can be done without it being necessary to extract from the trench the rear and central portions 12 and 14 of the machine.

Furthermore, the horizontally-disposed actuators make it easier to extract the machine 10 from the trench 21 which makes it easier in particular to perform maintenance operations.

To do this, the horizontally-disposed actuators are actuated so that their pistons are retracted into the cylinders of the actuators 44, thereby shortening the length of the central portion 14 and thus also of the machine 10.

In this first embodiment, it is advantageous to use the "jigsaw" first variant of the cutter module as described above.

Figure 10:
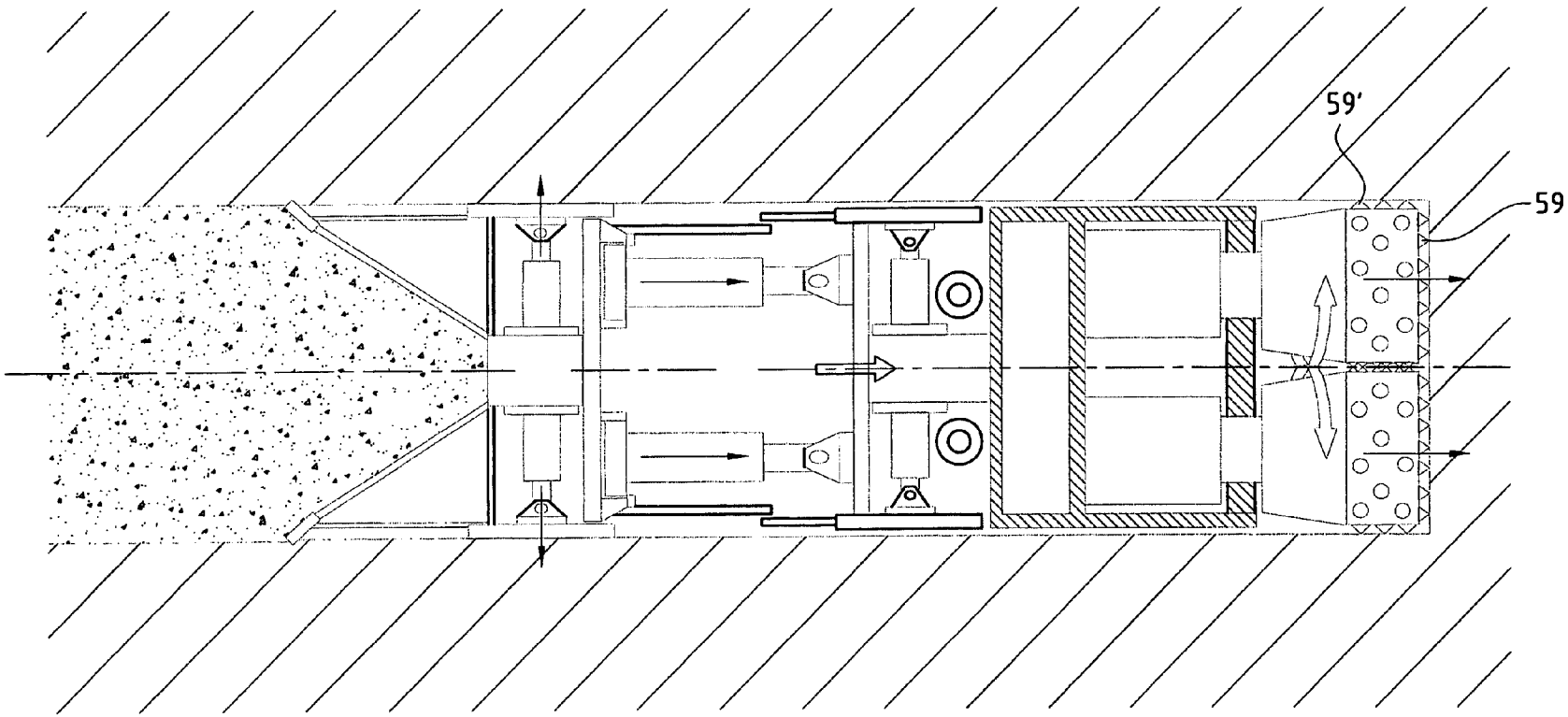
FIG. 10 is a plan view of the second embodiment of the machine of the invention, in which the rear portion is blocked and the thrust means are exerting thrust on the excavator means.
Figure 11:
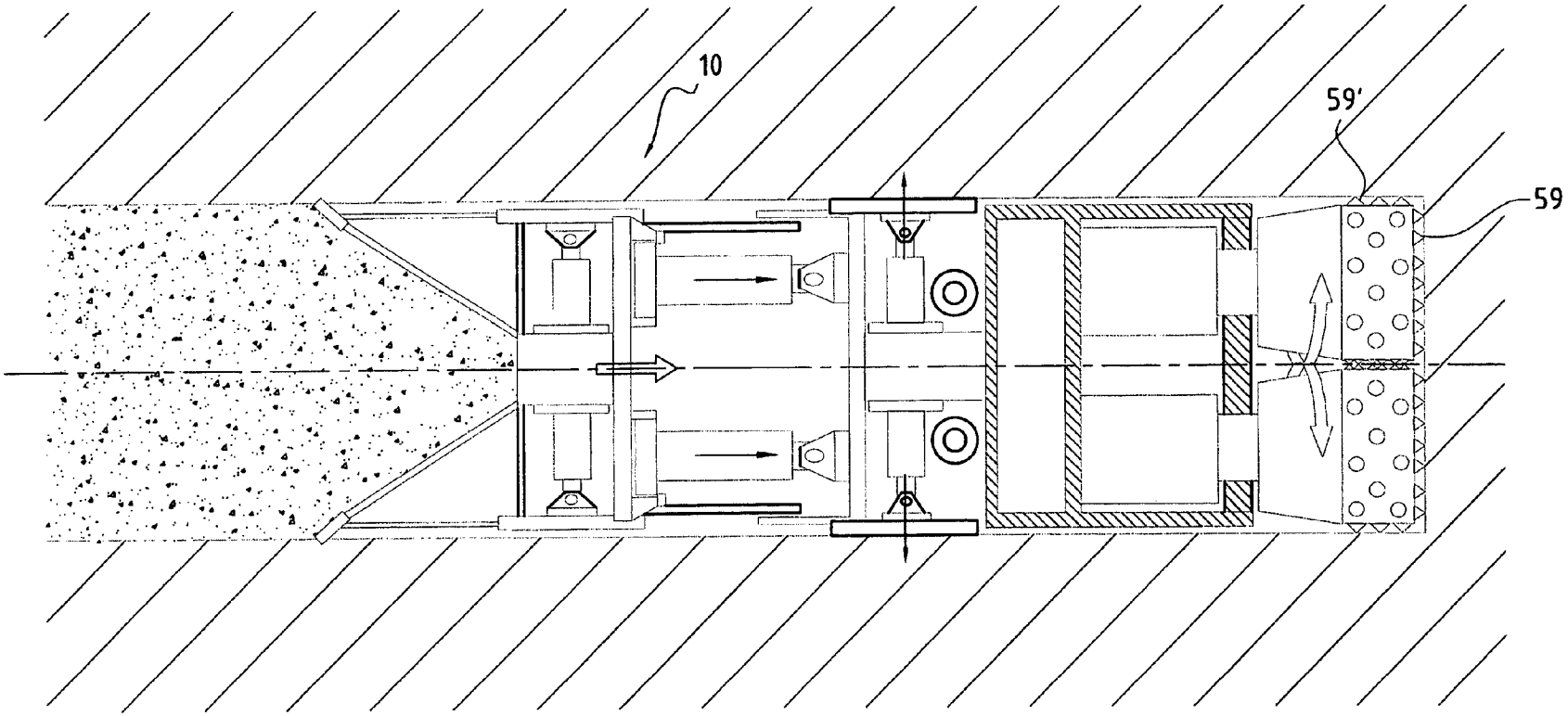
FIG. 11 is a plan view of the second embodiment of the machine of the invention in which the front portion is blocked and the propulsion means are moving the rear portion towards the front portion of the machine.
Figure 12:
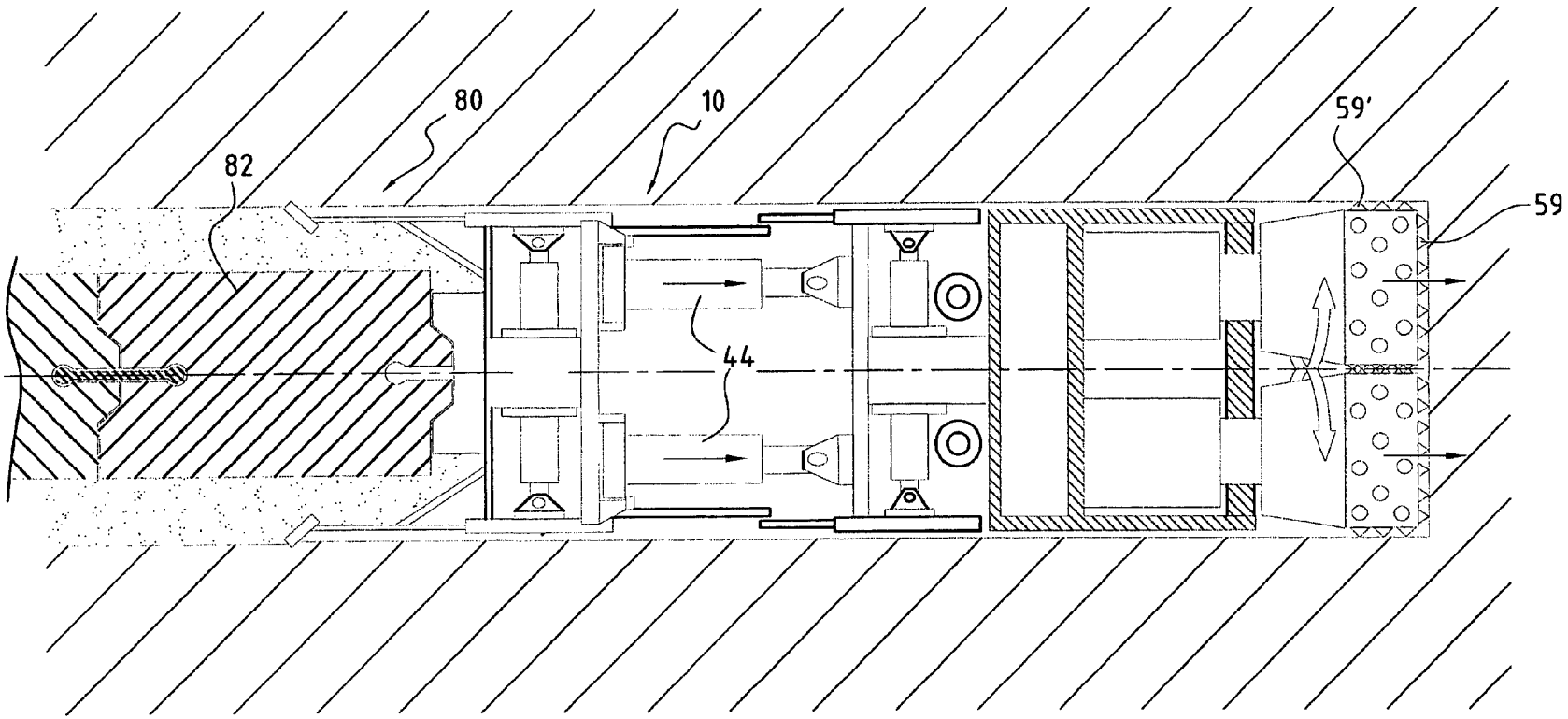
FIG. 12 is a plan view of the second embodiment of the machine, in which the propulsion means are pressing against a prefabricated wall element in order to move the excavator module.

With reference to FIGS. 10 to 12, there follows a description of the second embodiment of the machine 10 of the invention.

In the second embodiment, the machine 10 of the invention has propulsion means preferably comprising the horizontally-disposed actuators 44 together with the vertically-disposed actuators 52.

In the second embodiment of the machine, in order to move the rear portion of the machine it is preferable to block the rear portion 12 of the machine 10 relative to the trench 21 by actuating the rear brake device 30 so that the horizontally- or vertically-disposed actuators 44 or 52 can bear against the rear portion 12 of the machine 10 in order to be able to move the cutter module 18, where said movement can be horizontal and/or vertical.

In a first variant, the wall-forming means comprise concreting liquid injectors 22 such that in order to advance the machine, the front brake device 36 is actuated, the rear brake device 30 is released, and preferably, although not necessarily, concreting liquid is injected, thereby causing the rear portion 12 to move towards the front portion 14.

Thereafter, the injection of concreting liquid is stopped, the rear brake device 30 is blocked again, the front brake device 36 is released, and the horizontally- and/or vertically-disposed actuators 44 and/or 52 are actuated again to cause the front portion 16 of the machine 10 to advance.

It will be understood that this succession of movement enables the machine 10 to be caused to advance in an "earthworm" movement mode in which the front portion and then the rear portion of the machine are caused to advance in alternation.

In a second variant, the wall-forming means comprise a device 80 for inserting prefabricated wall elements 82, as can be seen in FIG. 12.

In this variant, shown in FIG. 12, the propulsion means comprise the horizontally-disposed actuators 44 in the central portion 14. These actuators are suitable for bearing against a prefabricated wall element 80 in order to move the excavator means.

In order to advance the machine 10, the front brake device 36 is actuated to block the front portion 18 of the machine 10, and then the horizontally-disposed actuators 44 are actuated while bearing against the front portion 16 in order to move the rear portion 12 towards the front portion 16. Finally, the excavator means are moved forward so as to advance the front portion 16 of the machine 10.

In this configuration likewise, it will be understood that this succession of movements enable the machine of the invention to be caused to advance.

In the second embodiment of the machine, it is also possible advantageously to use the first variant of the cutter module suitable for operating in a "jigsaw" mode.

Under such circumstances, the thrust means preferably include at least the actuators of the propulsion means.

Earth in the zone of the trench that is currently being excavated can be supported by filling the trench with a mud or an equivalent material.

Such support or retention can also be achieved by the side walls of the machine itself, pressing against the portion of the trench that is being excavated. Behind the excavator machine, the trench is filled by the wall that is put into place progressively as the machine advances, as explained above.

What is claimed is:

1. A machine for digging a trench and making a wall in said trench, the machine being suitable for advancing along a path and comprising rear and front portions relative to the direction of advance of the machine, together with:

excavator means disposed in the front portion of the machine and defining a substantially vertical cutting front;

wall-forming means situated in the rear portion of the machine; and propulsion means suitable for causing the machine to advance along said path;

the machine further comprising a central portion, controllable brake means for slowing advance or blocking at least one portion of the machine, and controllable connection and disconnection means for connecting and disconnecting the central portion respectively with the front and rear portions of the machine, thereby enabling the type of excavator means and the type of wall-forming means to be changed, wherein the machine further comprises guide means situated in the central portion for modifying the path by causing the cutting front to pivot in a horizontal plane relative to the rear portion of the machine, wherein the front portion of the machine can pivot relative to the rear portion of the machine, and wherein the guide means comprise at least one actuator engaged between the front and rear portions of the machine, so that actuating said at least one actuator causes the front portion to pivot relative to the rear portion of the machine.

2. A machine according to claim 1, wherein the wall-forming means comprise at least one concreting liquid injector for filling the portion of trench situated behind the machine, and wherein the propulsion means comprise said at least one concreting liquid injector.

3. A machine according to claim 2, wherein the guide means comprise at least two rows of actuators, said rows being disposed vertically on either side of a horizontal mid-plane of the machine.

4. A machine according to claim 1, wherein the wall-forming means comprise at least one row of injectors disposed vertically, pointing rearwards relative to the direction of advance of the machine, so as to inject the concreting liquid under pressure into the trench behind the machine, so that the injection of liquid under pressure also contributes to propelling the machine.

5. A machine according to claim 2, wherein the excavator means are movable relative to the wall-forming means, and wherein the machine further comprises thrust means situated in the central portion of the machine, suitable for exerting a horizontally—and/or vertically—oriented force on the excavator means.

6. A machine according to claim 1, wherein the excavator means are movable relative to the wall-forming means, and wherein the propulsion means are situated at least in part in the central portion of the machine and are suitable for moving the excavator means horizontally and/or vertically relative to the wall-forming means.

7. A machine according to claim 6, wherein the brake means comprise a rear brake device suitable for blocking the rear portion of the machine relative to the trench, and wherein the propulsion means are suitable for moving the excavator means forwards when the rear portion of the machine is blocked by said rear brake device.

8. A machine according to claim 6, wherein the wall-forming means comprise a device for inserting prefabricated wall elements behind the machine, and wherein the propulsion means are suitable for bearing against an inserted prefabricated wall element in order to enable the excavator means to be moved horizontally and/or vertically.

9. A machine according to claim 6, wherein the wall-forming means comprise at least one concreting liquid injector designed to fill the portion of trench situated behind the machine, and wherein the propulsion means further comprise said at least one concreting liquid injector.

10. A machine according to claim 6, wherein the brake means further comprise a front brake device suitable for blocking the front portion of the machine relative to the trench, and wherein the propulsion means are suitable for moving the rear portion of the machine towards the front portion when the front portion is locked by said front brake device.

11. A machine according to claim 6, wherein the machine further comprises thrust means suitable for exerting horizontal and/or vertical thrust on the excavator means.

12. A machine according to claim 11, wherein the thrust means comprise at least one actuator secured between the front portion and the rear portion, disposed in a substantially horizontal direction, and suitable for exerting horizontal thrust on the excavator means.

13. A machine according to claim 12, wherein the thrust means comprise at least two rows of horizontal actuators, said rows being disposed vertically.

14. A machine according to claim 11, wherein the thrust means comprise at least one actuator engaged between the central portion and the front portion of the machine, disposed in a substantially vertical direction, and suitable for exerting vertical thrust on the excavator means.

15. A machine according to claim 14, wherein the thrust means comprise at least two rows of vertical actuators, said rows being disposed vertically.

16. A machine according to claim 1, wherein the controllable brake means comprise a front brake device comprising at least one actuator extending transversely relative to the path of the machine and co-operating with the front portion of the machine, said at least one actuator being provided at its free end with a friction plate suitable for being put into contact with a face of the trench when said actuator is actuated.

17. A machine according to claim 1, wherein the controllable brake means comprise a rear brake device comprising at least one actuator extending transversely relative to the path of the machine and co-operating with the rear portion of the machine, said at least one actuator being provided at its free end with a friction plate suitable for being put into contact with a face of the trench when said actuator is actuated.

18. A machine according to claim 1, wherein the excavator means can be moved horizontally and/or vertically relative to the rear portion of the machine.

19. A machine according to claim 2, wherein the flow rate and/or the pressure of the liquid leaving an injector is/are controllable.

20. A machine according to claim 9, wherein the flow rate and/or the pressure of the liquid leaving an injector is/are controllable.

21. A machine for digging a trench and making a wall in said trench, the machine being suitable for advancing along a path and comprising rear and front portions relative to the direction of advance of the machine, together with:

excavator means disposed in the front portion of the machine and defining a substantially vertical cutting front;

wall-forming means situated in the rear portion of the machine; and propulsion means suitable for causing the machine to advance along said path;

the machine further comprising a central portion, controllable brake means for slowing advance or blocking at least one portion of the machine, and controllable connection and disconnection means for connecting and disconnecting the central portion respectively with the front and rear portions of the machine, thereby enabling the type of excavator means and the type of wall-forming means to be changed, wherein the excavator means are movable relative to the wall-forming means, and wherein the propulsion means are situated at least in part in the central portion of the machine and are suitable for moving the excavator means horizontally and/or vertically relative to the wall-forming means, wherein the controllable brake means comprise a front brake device comprising at least one actuator extending transversely relative to the path of the machine and co-operating with the front portion of the machine, said at least one actuator being provided at its free end with a friction plate suitable for being put into contact with a face of the trench when said actuator is actuated.

22. A machine according to claim 21, wherein the controllable brake means comprise a rear brake device comprising at least one actuator extending transversely relative to the path of the machine and co-operating with the rear portion of the machine, said at least one actuator being provided at its free end with a friction plate suitable for being put into contact with a face of the trench when said actuator is actuated.

23. A machine according to claim 21, wherein the excavator means can be moved horizontally and/or vertically relative to the rear portion of the machine.

24. A machine according to claim 21, wherein the brake means comprise a rear brake device suitable for blocking the rear portion of the machine relative to the trench, wherein the propulsion means are suitable for moving the excavator means forwards when the rear portion of the machine is blocked by said rear brake device, and wherein the propulsion means are suitable for moving the rear portion of the machine towards the front portion when the front portion is locked by said front brake device.

25. A machine for digging a trench and making a wall in said trench, the machine being suitable for advancing along a path and comprising rear and front portions relative to the direction of advance of the machine, together with:

excavator means disposed in the front portion of the machine and defining a substantially vertical cutting front;

wall-forming means situated in the rear portion of the machine; and propulsion means suitable for causing the machine to advance along said path;

the machine further comprising a central portion, controllable brake means for slowing advance or blocking at least one portion of the machine, and controllable connection and disconnection means for connecting and disconnecting the central portion respectively with the front and rear portions of the machine, thereby enabling the type of excavator means and the type of wall-forming means to be changed, wherein the excavator means are movable relative to the wall-forming means, and wherein the propulsion means are situated at least in part in the central portion of the machine and are suitable for moving the excavator means horizontally and/or vertically relative to the wall-forming means, wherein the machine further comprises thrust means suitable for exerting horizontal and/or vertical thrust on the excavator means, and wherein the thrust means comprise at least one actuator engaged between the central portion and the front portion of the machine, disposed in a substantially vertical direction, and suitable for exerting vertical thrust on the excavator means.

26. A machine according to claim 25, wherein the brake means comprise a rear brake device suitable for blocking the rear portion of the machine relative to the trench, and wherein the propulsion means are suitable for moving the excavator means forwards when the rear portion of the machine is blocked by said rear brake device.

27. A machine according to claim 25, wherein the wall-forming means comprise a device for inserting prefabricated wall elements behind the machine, and wherein the propulsion means are suitable for bearing against an inserted prefabricated wall element in order to enable the excavator means to be moved horizontally and/or vertically.

28. A machine according to claim 25, wherein the wall-forming means comprise at least one concreting liquid injector designed to fill the portion of trench situated behind the machine, and wherein the propulsion means further comprise said at least one concreting liquid injector.

29. A machine according to claim 25, wherein the brake means further comprise a front brake device suitable for blocking the front portion of the machine relative to the trench, and wherein the propulsion means are suitable for moving the rear portion of the machine towards the front portion when the front portion is locked by said front brake device.

30. A machine according to claim 25, wherein the thrust means comprise at least one actuator secured between the front portion and the rear portion, disposed in a substantially horizontal direction, and suitable for exerting horizontal thrust on the excavator means.

31. A machine according to claim 30, wherein the thrust means comprise at least two rows of horizontal actuators, said rows being disposed vertically.

32. A machine according to claim 25, wherein the thrust means comprise at least two rows of vertical actuators, said rows being disposed vertically.

33. A machine according to claim 25, wherein the controllable brake means comprise a front brake device comprising at least one actuator extending transversely relative to the path of the machine and co-operating with the front portion of the machine, said at least one actuator being provided at its free end with a friction plate suitable for being put into contact with a face of the trench when said actuator is actuated.

34. A machine according to claim 25, wherein the controllable brake means comprise a rear brake device comprising at least one actuator extending transversely relative to the path of the machine and co-operating with the rear portion of the machine, said at least one actuator being provided at its free end with a friction plate suitable for being put into contact with a face of the trench when said actuator is actuated.

35. A machine according to claim 25, wherein the excavator means can be moved horizontally and/or vertically relative to the rear portion of the machine.

36. A machine according to claim 25, wherein one or both of the flow rate and the pressure of the liquid leaving an injector is controllable.

* * * * *